United States Patent [19]

Peck

[11] 4,021,816

[45] * May 3, 1977

[54] HEAT TRANSFER DEVICE

[75] Inventor: Wayne P. Peck, St. Petersburg, Fla.

[73] Assignee: E-Systems, Inc., Dallas, Tex.

[ * ] Notice: The portion of the term of this patent subsequent to July 27, 1993, has been disclaimed.

[22] Filed: Aug. 8, 1975

[21] Appl. No.: 603,198

Related U.S. Application Data

[63] Continuation-in-part of Ser. No. 407,478, Oct. 18, 1973, Pat. No. 3,971,435, which is a continuation-in-part of Ser. No. 162,084, July 13, 1971, Pat. No. 3,803,688.

[52] U.S. Cl. ..... 343/840; 343/912; 165/105; 29/157.3 R

[51] Int. Cl.[2] ..... H01Q 1/02; H01Q 19/12

[58] Field of Search ..... 165/105, DIG. 3, 78; 29/157.3 R; 343/840, 912

[56] References Cited

UNITED STATES PATENTS

| | | | |
|---|---|---|---|
| 1,671,647 | 5/1928 | McCarthy | 165/170 |
| 3,429,122 | 2/1969 | Pravda et al. | 165/105 X |
| 3,502,138 | 3/1970 | Shlosinger | 165/105 X |
| 3,528,494 | 9/1970 | Levedahl | 165/105 |
| 3,535,543 | 10/1970 | Dailey | 165/105 X |
| 3,598,177 | 8/1971 | Webster | 165/105 X |
| 3,789,920 | 2/1974 | Low | 165/105 |

OTHER PUBLICATIONS

Kemme, J. E., *Proceedings...Heat Pipe Conf.*, Space Isotope Power Dept., Sandia Labs., (Oct. 1966), (SCM-6-6-623 Microfische), pp. 1, 12-24.

*Primary Examiner*—Albert W. Davis, Jr.
*Attorney, Agent, or Firm*—Hopgood, Calimafde, Kalil, Blaustein & Lieberman

[57] ABSTRACT

The invention contemplates a heat-transfer device or heat pipe characterized by integral screen-wick structure providing relatively great contact area between the internal working fluid or condensable medium and the heat input.

14 Claims, 28 Drawing Figures

Fig. 7A.
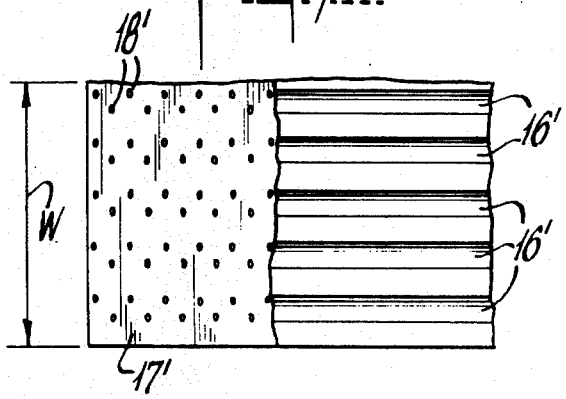
Fig. 7B.
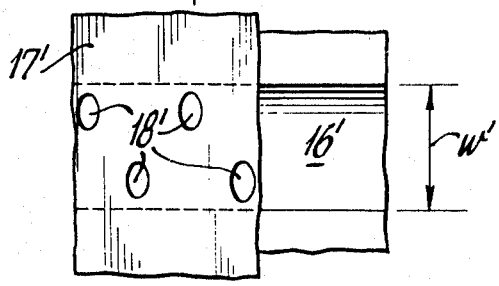
Fig. 7C.
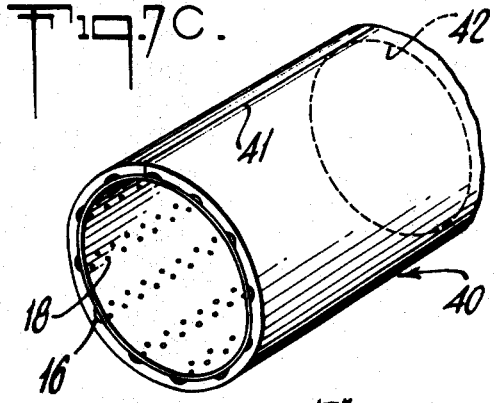
Fig. 8B.
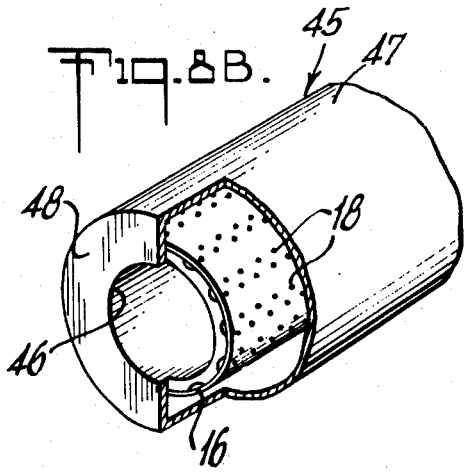
Fig. 8A.
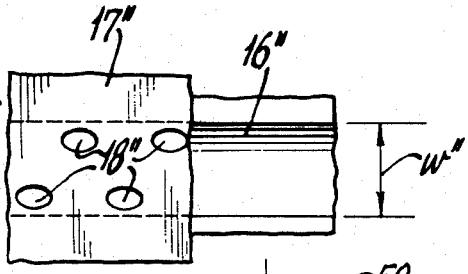
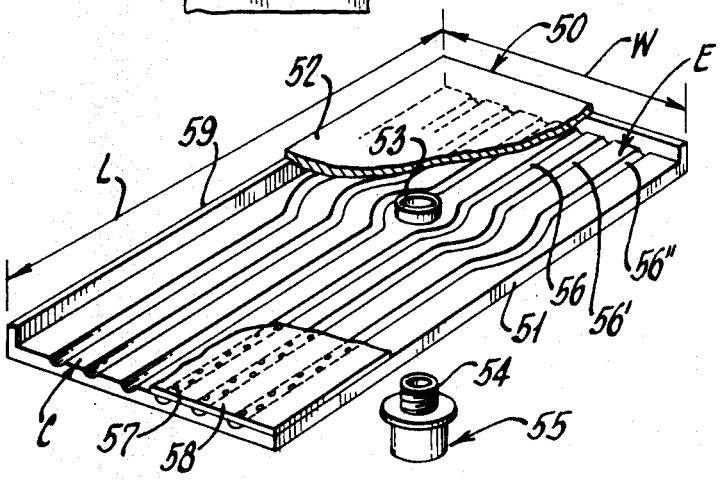
Fig. 9.
Fig. 10.
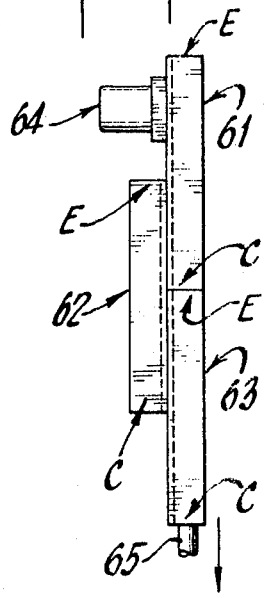

HEAT TRANSFER DEVICE

This is a continuation-in-part of my copending application Ser. No. 407,478, filed Oct. 18, 1973, now U.S. Pat. No. 3,971,435 which application is a continuation-in-part of my application, Ser. No. 162,084, filed July 13, 1971, now U.S. Pat. No. 3,803,688.

This invention relates to heat-transfer devices, such as heat pipes, and to a process for making a heat-transfer surface structure therefor. More particularly, the invention relates to heat pipes having integral screen wicks which are suitable for use in liquid-vapor phase systems. It has been suggested that the term "screen wick" may carry a confusing association with woven-wire mesh structures of the prior art, and therefore the expression "non-woven" will sometimes be used to distinguish from such prior art the novel integral foraminated plate wicks of the invention; and the term "integral" will further be understood to identify the permanent and continuously united relationship between such non-woven plate structure and the grooved base plate with which it cooperates, as will be made clear.

Heat pipes are devices of high thermal conductance employing the principles of evaporation, vapor-heat transfer, condensation and capillary action. Vapor-heat transfer has long been known as an extremely efficient means of heat transfer and is usually employed in steam-heating plants.

Generally, in vapor-heat transfer, a transfer of heat energy occurs at the source through the evaporation of a given amount of liquid with the absorption of the heat of evaporation. The absorbed heat is then transported by the vapor to a heat sink with the deposition of the latent heat of a condensation. The heats of evaporation and condensation are equal. Thus, a large amount of heat is transported by a small amount of vapor. For example, if the working fluid is water, one gram will transport 2,260 joules; at a transfer rate of 1 gram per second, this corresponds to 2,260 watts.

However, the application of these principles (as utilized in steam-heating plants) to systems where smallness of size is of importance leaves much to be desired; steam-heating plants generally require large, complex cycling equipment which is difficult to adapt to systems where space is at a premium, as in electronic and aerospace applications. On the other hand, heat pipes which employ a combination of vaporization, condensation and wicking provide all of the advantages of vapor-heat transfer without the inclusion of elaborate, large, complex cycling equipment, since the basic heat pipe simply comprises a closed system having an evaporator area and a condenser area, separated by a duct, and a wick means located on the internal surface of the system which also contains a working fluid or condensable medium. In operation, the internal working fluid enters the duct, and the small temperature difference between the evaporator and condenser sections, along with the resulting difference in vapor pressure between the evaporator section and condenser section ( which is greater than zero, i.e., $P_2 - P_2 > 0$) causes the vapor to be driven through the duct to the condenser; upon condensation, the condensate returns to the evaporator by way of the wick means. As mentioned, heat transfer is accomplished with very little temperature gradient. Consequently, the device is very nearly isothermal.

Even with such relatively efficient and simple devices, there still exists a need for making them still more compact while at the same time increasing the surface area of the working fluid that comes into contact with the heat input.

It is, therefore, an object of the invention to provide a heat pipe which, within given dimensional limitations, has an increased contact area between the working fluid and the heat input; more specifically, it is an object to achieve the foregoing in a flat structure having substantially decreased thickness requirements.

Another object is to provide an improved heat-pipe construction having inherently low liquid-flow resistance and capable of maintaining good capillary pumping pressure, while allowing efficient vapor escape of boiling liquid.

Another object is to provide, in a device of the character indicated, an improved wick construction and method of making the same.

It is also an object to provide such wick structure with smaller than conventional dimensions for a given thermal performance.

A further object is to provide improved wick structure of such capillary efficacy that it will enable heat-pipe consturction of relatively large size and operative independent of wick orientation with respect to a gravity vector.

A further object is to provide such a method wherein dimensions in the ultimate wick can be accurately and reliably controlled, which method lends itself inherently to selective variation in order to maximize local physical properties, and which method lends itself to manufacture of flat wicks.

The present invention meets these and other objects by providing a heat-transfer device or heat pipe and a process for making the same, which has an integral non-woven, foraminated-plate screen-wick construction and wherein the heat input surrounds the internal working fluid and at the same time the height or thickness dimension can be held to a minimum (if desired) or increased as much as needed, without eliminating the increased contact-surface area between the internal working fluid and the heat input.

In order to understand the present invention more completely, reference is directed to the following description in conjunction with the accompanying drawings, wherein.

Figure 11:
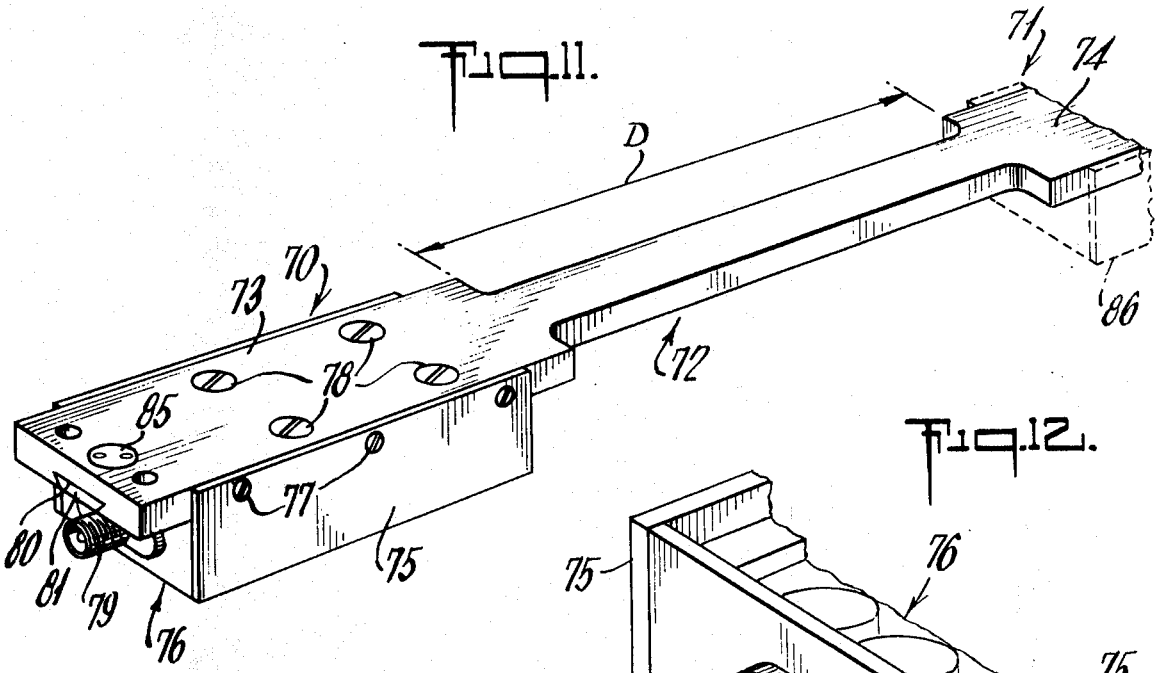
Figure 12:
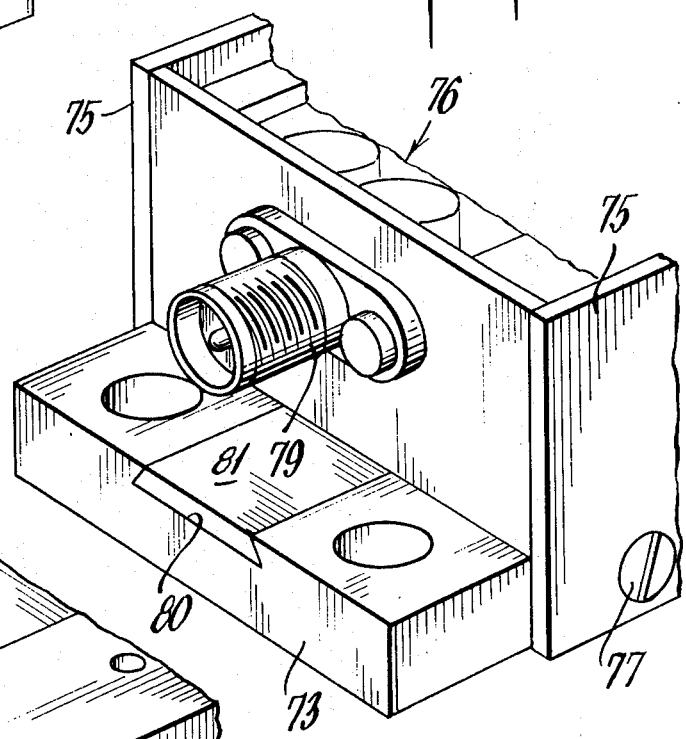
Figure 14:
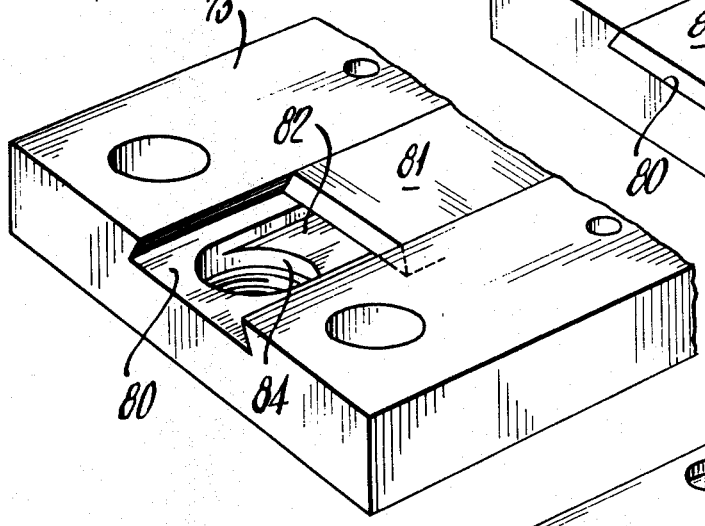
Figure 13:
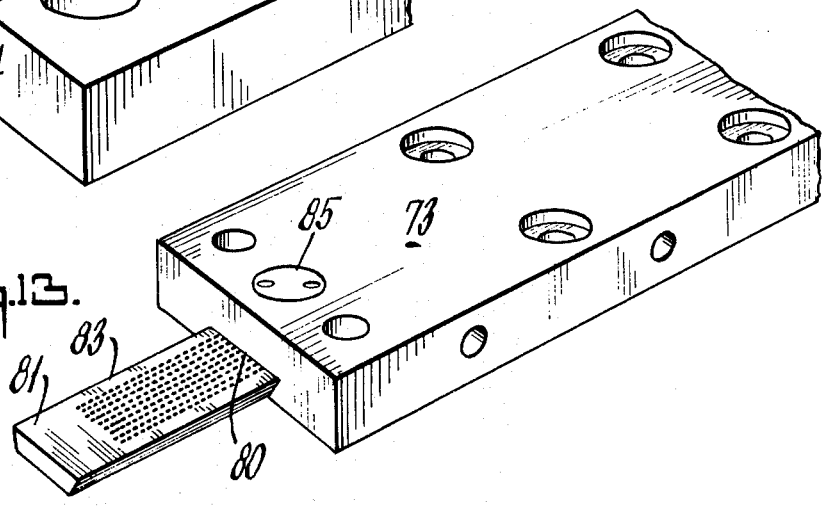
Figure 15:
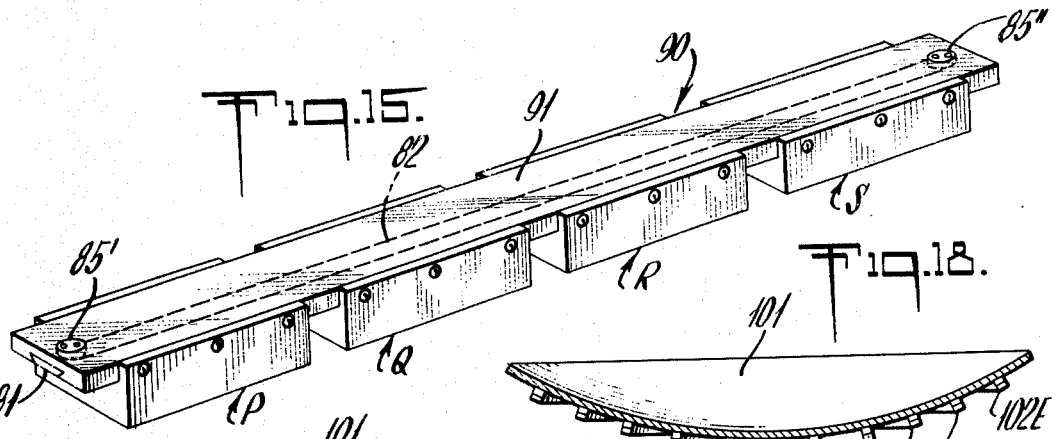
Figure 18:
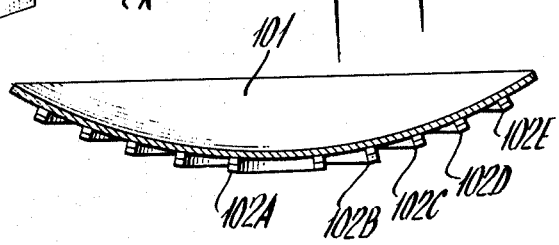
Figure 17:
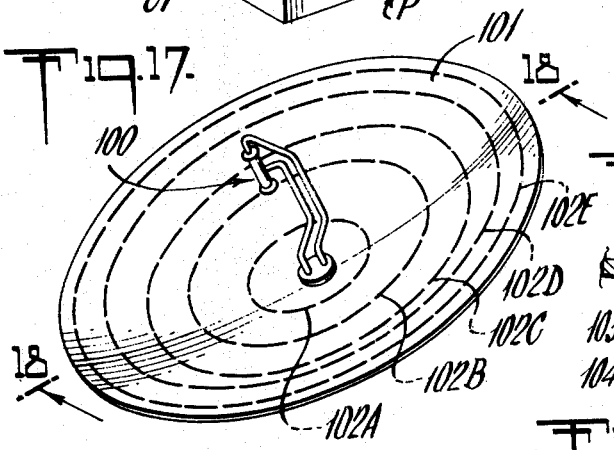
Figure 18A:
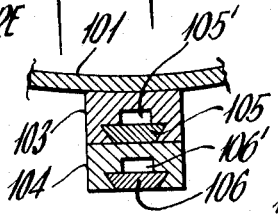
Figure 16:
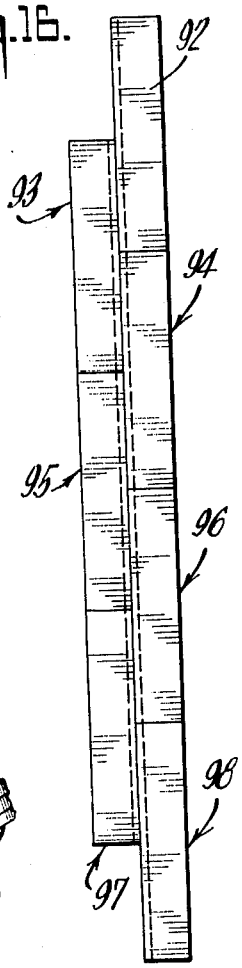
Figure 21:
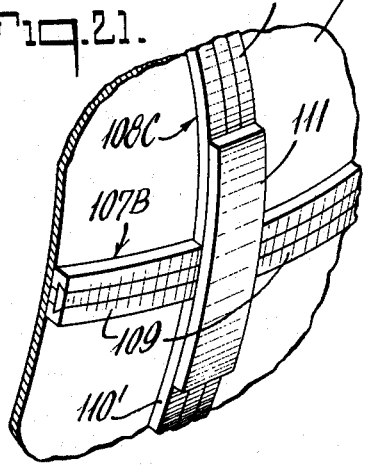
Figure 19:
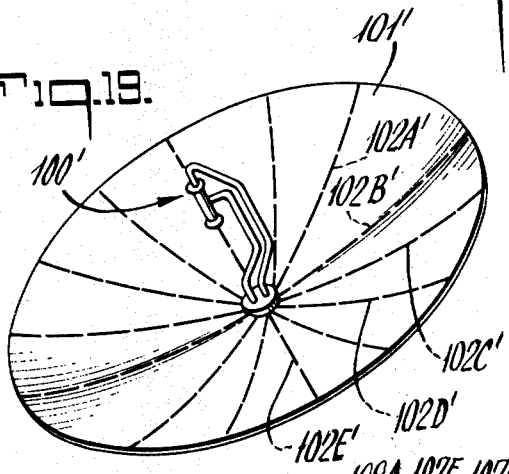
Figure 22:
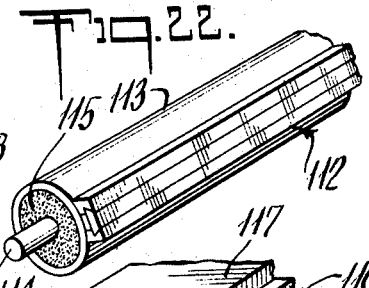
Figure 20:
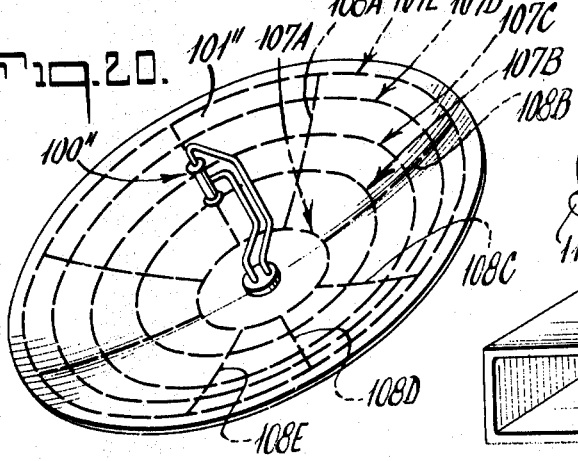
Figure 23:
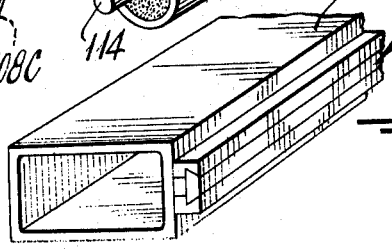

FIGS. 7A, 7B and 7C illustrate a modification wherein the integral-wick feature of the invention is embodied in an elongated cylindrical heat pipe, FIG. 7A being a plan view of the wick structure in a preliminary stage, FIG. 7B being an enlarged fragmentary view of the wick structure of FIG. 7A, and FIG. 7C being a perspective view of the completed pipe, cut at a radial plane to reveal internal detail;

FIGS. 8A and 8B are views similar to FIGS. 7B and 7C, respectively, to show a modification;

FIG. 9 is a simplified exploded view in perspective and partly broken away, showing a modified flat heat pipe;

FIG. 10 is a simplified view in elevation to show combined flat heat-pipe units;

FIG. 11 is a fragmentary view in perspective of an assembled electronic amplifier and flat heat pipe structure of the invention, as viewed from the underside;

FIG. 12 is an enlarged fragmentary view of the near-end exposed parts of FIG. 11, inverted to upright position;

FIG. 13 is a fragmentary perspective view of parts of FIG. 11, from the aspect of FIG. 11 but in the process of assembly;

FIG. 14 is a fragmentary perspective view of heat-pipe mounting parts of FIG. 12, in the process of assembly;

FIG. 15 is a view in perspective of a flat heat-pipe structure of the invention, in use as in isothermal device in conjunction with a plurality of electronic devices;

FIG. 16 is a view similar to FIG. 10, to illustrate isothermal employment of plural flat heat-pipe units;

FIG. 17 is a simplified perspective view of a parabolic-antenna system to which plural heat-pipe units of the invention have been applied for isothermal purposes;

FIG. 18 is a sectional view taken at 18—18 of FIG. 17, while FIG. 18A is an enlarged fragment of said view;

FIGS. 19 and 20 are similar to FIG. 17 to show modifications;

FIG. 21 is an enlarged fragmentary perspective view of the backside of a portion of the structure of FIG. 20; and FIGS. 22 and 23 are simplified fragmentary perspective views of further embodiments of the invention.

Briefly stated, a heat-transfer device or heat pipe in accordance with the invention comprises a sealed metal container having an evaporator region and a condenser region in which the internal surface of the container is provided with a plurality of capillary grooves. Covering the internal surface of the container and extending over the grooves is a non-woven wick element comprising an integral metallic plating containing a element comprising an integral metallic plating containing a plurality of openings or holes forming an integral screen, and providing communication between the grooves and the interior of the container. The container encloses a condensable medium in an amount sufficient to enter the grooves upon condensation and to be transported by capillary action through the grooves from the condenser region to the evaporator region of the container. The grooved construction with the integral metallic plating or screen provides increased surface-contact area between the condensable medium in the grooves and heat input passing through the grooved structure. The process for manufacturing the grooved, metallic, heat-transfer surface structure (including the integral screen) generally comprises forming a plurality of grooves in the surface of the structure, which may be a metal sheet, filling the grooves with a filler, applying an integral metallic plating on the entire surface of the structure, forming openings or holes in the integral metallic plating over the grooves, and removing the filler from the grooves. The resulting grooved, integral screen structure is then used to form a container, being shaped where necessary to suit the particular construction desired.

Figure 1:
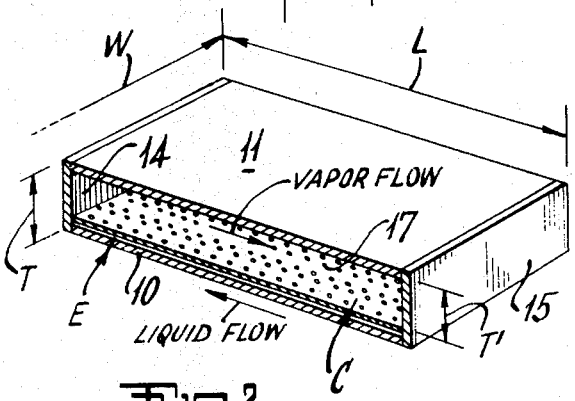
FIG. 1 is a simplified perspective view of a flat heat-transfer device or heat pipe of the invention, broken along a longitudinal section extending from end to end of the device.
Figure 1A:
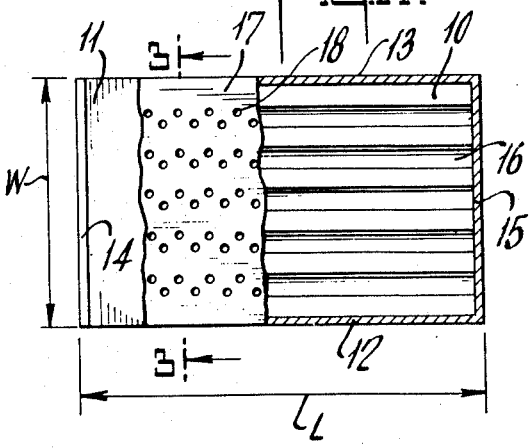
FIG. 1A is a simplified plan view of the device of FIG. 1, partly broken away at the successive levels *a—a* and *b—b* of FIG. 1, to reveal internal structure.

In FIGS. 1 and 1A, a flat heat-pipe embodiment of the invention is seen to comprise a sealed metal container, having a bottom wall or base 10, an upper wall 11 spaced above the base 10, side walls 12–13, and end wall 14–15. The basic overall length, width and thickness dimensions are designated L, W, and T, respectively, the longitudinal dimension ranging from an evaporator region E near the end 14, to a condensing region C near the end 15. The integral wick-screen of the invention is embodied as an inner-surface characterization of the base wall 10; basically, such characterization comprises a series of laterally spaced grooves or capillary channels 16 running the longitudinal extent of the device and covered by an integral metal-screen layer 17, having plural openings 18 therein, i.e., a single foraminated plate (17) continuously formed with and united to the groove face of the base 10. In operation, heat input in the region E of end wall 14 causes liquid to evaporate or "boil" at E and to develop sufficient locally elevated pressure to establish vapor flow in the direction indicated by legend; heat extraction in the region C of end wall 15 condenses the vapor at C, to replenish grooves 16 with liquid which, due to capillary action in grooves 16, is caused to flow (in the direction indicated by legend) back to the evaporator zone E, for recycling.

Figure 2:
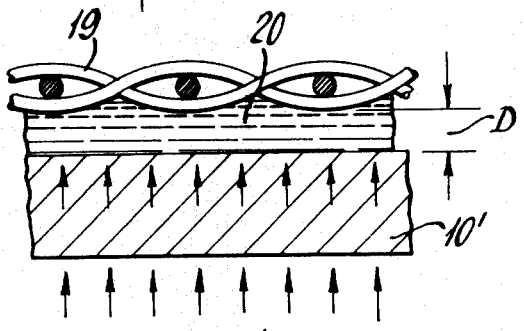
Fig.2. PRIOR ART
FIG. 2 is an enlarged fragmentary sectional view of part of a flat heat pipe employing a conventional woven-wire screen wick.

The detailed nature of the wick-screen structure of FIG. 1 can perhaps best be understood after brief description of a section of conventional structure, exemplified by FIG. 2. In FIG. 2, conventional construction is seen to include a metal base 10′, which is the heat-input surface, a woven-wire screen wick 19 spaced a distance D slightly away from the base and fixed in any convenient manner to the internal surface of the side and end walls (not shown). A suitable working fluid or condensable medium 20, such as water partially fills the vessel. As may be seen, the heat input, designated by arrows, contacts only one surface of the working fluid in this type of construction, i.e., the wetted area of base 10′ is the factor limiting base-to-liquid heat transfer.

Figure 3:
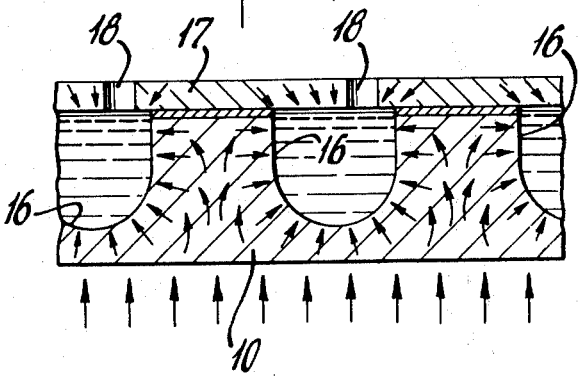
FIG. 3 is a view similar to FIG. 2, but taken at the line 3—3 of FIG. 1A and showing an integral non-woven screen-wick construction of the invention.

In contrast to the conventional woven-wire screen wick, FIG. 3 shows each groove 16 of the integral non-woven, foraminated-plate, screen-wick construction of the invention to contain the working fluid or condensable medium 20, each groove 16 forming one element of a capillary system. Each groove 16 is covered by the integral metal layer or plate 17, having plural openings 18 in register with each groove, and forming a non-woven screen wick. The base 10 functions as the main heat-input surface, and in the diagram heat flow is suggested by heavy arrows. Solid metal almost completely surrounds liquid working fluid, so that the heat input is transferred directly to the liquid, including transfer via contact with the integral screen or layer 17.

In a complete integral screen wick construction, a sufficient plurality of grooves 16 will afford a relatively great area of contact (per unit volume of liquid, and per unit volume of the overall device) between the working fluid or condensable medium 20 and the heat input, all as suggested by arrows.

Depending upon the amount of heat which must be removed by a heat pipe having the integral non-woven screen construction of this invention, there can be wide variation in the parameters of total overall size with respect to length, width, height or thickness, as well as in the number, depth, width and length of the grooves 16, thickness of the integral-screen metallic layer 17, the size and number of openings 18 therein, and the amount and nature of working fluid. Moreover, the most efficient geometric pattern for a given set of conditions is determinable by mathematical calculation and/or computerized thermal-simulation analysis. In general, however, in a heat pipe of the invention, the base which provides the main heat-input surface, should be as thin as possible, consistent with the thickness and strength needed to permit a maximum number of grooves of maximum depth, all to the end that there be maximum contact area of the working fluid with the heat input. Groove depth and width should not exceed size limitations for capillary action; and space between grooves 16 should not be so reduced as to choke the heat-input flow to layer 17. Furthermore, the parametric dimensions and proportions should be sufficient to provide an outside contact area large enough to receive and remotely transmit heat generated by a given source object to the extent necessary to maintain that object in the desired thermal condition, steady state or otherwise. The integral-screen surface 17 should be as thin as possible, with a maximum number of openings, in order to provide a vapor-venting function, as in a woven-screen structure.

The overall height or thickness of a heat pipe in accordance with the invention may vary. However, in keeping with the ideal situation of making the heat pipe as flat as possible and still of an operative geometric configuration in regard to height or thickness, the internal space T′ (FIG. 1) above the integral-screen structure should be of sufficient height and volume to accommodate the vapor phase of the working fluid, without compromising action at the evaporator region E and at the condenser region C.

Any metal or metal alloy having good heat-conducting properties and preferably good malleability can be employed in making a heat pipe in accordance with the invention. Suitable metals include but are not limited to copper, brass, steel, and aluminum, and alloys thereof. Copper, however, is a preferred metal, since it has excellent malleability and good heat conductivity.

The working fluid or condensable medium can vary widely and may be a liquid or a gas under normal conditions. When a normal liquid medium is employed, it should be selected for its ability to vaporize and to condense under the conditions to which it is subjected in use. On the other hand, when the working fluid is normally a gas, it should be condensable under conditions of use and be susceptible to reconversion to its gaseous state form upon passage through the integral screen-wick structure by capillary action. Suitable materials which can be employed as the working medium include, but are not limited to, water, steam, fuorocarbons, and the like. The room-temperature pressure conditions within the sealed structure will, of course, depend upon the design temperature range of the device, upon the liquid medium selected, as will be understood.

Heat-transfer surface structure of the invention and of the nature described above, may be manufactured by chemical etching in a predetermined pattern on a metallic structure or sheet; such technique is particularly suited to mass-production and at the same time exhibits a high degree of controllability and reliability. Thus, specifically, in accordance with a preferred method of the invention, a coating of photo-resist material is first applied to a metallic surface, and a groove pattern is exposed in the photo-resist material. The photo-resist material having the groove (16) pattern exposed therein is then developed, and a suitable etchant is applied to the surface (containing the developed pattern) to form grooves in the metallic surface. The grooves are filled with a filler, and a metallic plating base is applied at least on the filler, before plating a metallic layer over the entire surface. A coating of photo-resist material is next applied to the metallic layer, and a hole pattern is exposed in the photo-resist material; after developing the thus-exposed photo-resist material, a suitable etchant is applied to the developed surface to form holes in the metallic layer. Thereafter, the filler is dissolved and removed from the grooves 16, to leave an integral-screen structure as described.

In carrying out the process of the invention, any known photo-resist material can be employed so long as it and the metallic material being etched are compatible with the particular etchant being used to achieve etching in the desired pattern. In this regard, known etchants such as ammonium persulfate, nitric acid, ammonium hydroxide, and ammonium carbonate combination, ferric chloride, and the like may be used in carrying out the process of the invention. Among these, ferric chloride is a particulary useful etchant when processing copper, a preferred metal useful in the practice of this invention.

Photo-resist materials which may be employed include KPR (Eastman-Kodak Co.), KMER (Eastman-Kodak Co.), PR (Dynachem Corp.), and the like.

For best results, the surface to be etched should be chemically cleaned befor application of the photo-resist material. Any of the known chemical cleaning agents useful in preparing metal surfaces for further processing can be utilized. Among these are Keolite 235, Lectrite, NF, and Metex L-5 (Mac Dermid Inc.), the latter being particularly useful with copper.

The photo-resist coating can be applied in any convenient manner, as by brushing, painting, dipping, and the like. However, such care should be taken in applying the coating that a uniform film of photo-resist material is obtained on the metal surface.

The pattern for the grooves (16), as well as for the openings or holes (18) in the metallic layer which forms the non-woven screen, may be generated in a known manner on an enlarged scale, with the aid of a computer and an automatic plotter, after which the generated patterns may be photographically reduced to appropriate size for a given heat-pipe design and used as film-pattern masters in the etching process, being exposed in the photo-resist material applied to the metal base and developed in the known manner. Etching then takes place by subjecting the surface of the developed photo-resist material to a suitable etchant for a period of time sufficient to achieve the desired groove width and depth. When etching is completed, any remaining photo-resist material is removed in a convenient manner, as by physically stripping or washing the grooved surface with a solvent for the photo-resist material.

The grooves are then filled preferably with a suitable plastic filler such as Rigidax Type-W1 (M. Argueso & Co., Inc.), polystyrene, and the like, although readily soluble non-plastics may also be used, as for example, paraffin, cero alloys, and the like. The filler is then machined to make it flush with the metal surface. It is generally recommended that, after machining, the entire surface be cleaned again with Metex L-5 (Mac Dermid Inc.) or other suitable cleaner. This is especially so when using a plastic filler such as Rigidax (M. Arguesco & Co. Inc.), in order to be sure that no oil film is left. The surface is now ready for the plating step, which may or may not include the application of a metallic plating base to the filler. In cases in which the filler is compatible with the metallic layer to be next applied, electroplating of the metallic layer is then accomplished by known procedures for a period of time sufficient to deposit a metallic layer of the desired thickness over the entire grooved surface of the structure being processed. On the other hand, should the filler be incompatible with the metallic layer, a metallic plating base is applied on the filler by any known electroless-plating process; for example, in the event of using Rigidax (M. Arguesco & Co. Inc.) as a plastic filler, chemical deposition from a suitable electroless-plating bath of copper sulfate and formaldehyde is performed for a period of time sufficient to achieve a continuous thin coating of the metallic plating base on the surface of the filler.

It is to be noted that the metallic plating base may be one which is or is not compatible with the metal surface of the base structure. So long as the base structure and the metallic material to be electroplated thereon are compatible with each other, the metallic plating base need only be compatible with the filler and the electroplated metal. On the other hand, where such is not the case, a metallic plating base (compatible with the layer to be electro-plated, the filler, and the metal of the base structure) can be used to cover the entire surface by electroless plating.

After electroplating the metallic layer which is to form the non-woven screen, the openings or holes 18 are formed in the layer 17, after performing the recommended cleaning step; thus, openings 18 are formed by the indicated photo-resist coating procedure, exposing a hole pattern in the photo-resist material, and carrying out the development and etching steps on the electroplated metallic layer.

Subsequent to the hole-forming etching step, the filler is removed by dissolving it in the suitable solvent. The dissolution may be carried out by immersing the entire structure in a solvent bath until dissolution is complete. Suitable solvents which are compatible with fillers such as Rigidax, paraffin, and polystyrene are trichlor ethylene, tuluol, and xylene.

Finally, to enhance wetting of the surface of the resulting wick structure and to improve capillary flow in grooves 16, the product is preferably cleaned by contacting with Metex L-5 and by chemical contacting with materials such as 10% mixture of sodium polysulfide in water, or a solution of 1 pound copper carbonate in 1 quart of ammonium and 2½ quarts of water, or by anodizing, and the like.

Figure 4:
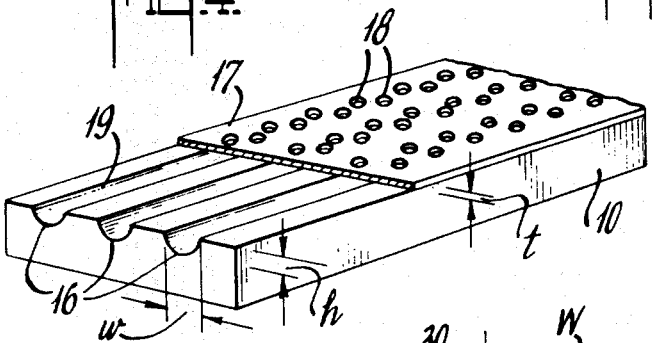
FIG. 4 is an enlarged perspective view, partly broken-away and in section, showing a partially completed heat-pipe base structure of the invention, and also illustrating certain process steps of the invention.

A specific example of copper-base structure of the character indicated is illustrated in partially completed state in FIG. 4. A base 10, 3 inches long, one inch wide and 0.125 inch thick, and provided with three parallel grooves 16, is shown filled with undissolved plastic filler 21, running lengthwise therein. The groove width $w$ was 0.202 inch and the height $h$ was 0.015 inch. The screen (17) thickness $t$ was 0.005 inch. Over each groove 16, openings (19) were of 0.010 inch diameter, and at about 0.015 inch spacing, in staggered relation, as shown.

Figure 5:
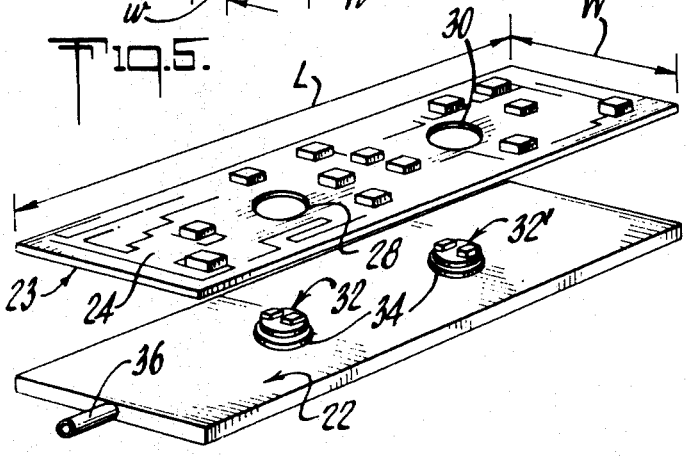
FIG. 5 is a simplified view in perspective showing, in exploded relation, a flat heat pipe of the invention in conjunction with a thin-film power-amplifier module.

An excellent flat copper heat-transfer device 3 inches × 1 inch × 13 inches was made using the above-described base, as the lower walls 10, otherwise closed by remaining walls (11 to 15), and employing water as the working fluid; the device (22, FIG. 5) may be used to extract heat from a thin-film 25-watt UHF power-amplifier module 23. Passive thin-film circuitry 24 of the module 23 was arranged on an alumina substrate 26 having suitable openings 28 and 30 for the reception of transistor chips 32-32′, seated in beryllia studs or on platforms 34 fixed, as by brazing, to an outer wall of the heat pipe 22; the wall 10 having the integral screen-wick of the invention will be understood to be the wall adjacent platforms 34 and substrate 26, and a flat heat-pipe lead or conduit 36 served to connect the flat heat pipe 22 to a remote heat sink (not shown).

Heat-transfer devices incorporating the integral-wick structure of the invention and the process for manufacturing the wick structure both present many advantages. For example, flat heat pipes (as thus far described) can be made more compact, thereby requiring less space. The single thin foraminated plate integrally united to the base, and covering the grooved face thereof, results in superior thermal and liquid transfer properties. The etched grooves provide open-flow channels with low resistance to longitudinal flow within the wick. The groove walls provide the rugged and precise screen support necessary for sustained capillary pumping pressure, and thus assuring recycled flow of condensed material to the evaporator region of the device. The process allows the construction of continous, unobstructed flow channels which are encased in metal, allowing heat to be transferred through the walls of the channels rather than through the relatively non-conductive liquid, thus achieving greater heat flow per unit area. Furthermore, the process allows accurate control of the screen openings and their distribution, with enhanced efficiency of vapor condensing.

Figure 6:
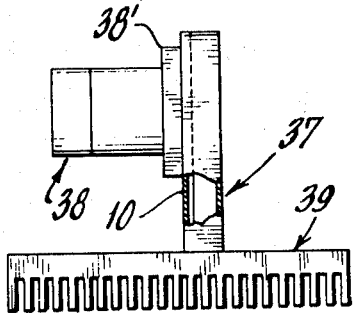
FIG. 6 is a simplified view in elevation to show another applied context for a flat heat pipe of the invention.

It is to be understood that many variations of the embodiments of this invention may be made without departing from the spirit and scope thereof. For example, in FIG. 6, a single flat heat pipe 37 is used to extract heat from a high-power electronic device 38 (at its base connection 38′ to the evaporator end of pipe 37) and to dissipate the heat via a suitably finned member 39 by which sufficient cooling can be applied at the condensation end of pipe 37 to assure heat-pipe recycling. Also, for example, FIGS. 7A, B, C illustrate application to one cylindrical embodiment, and another is shown in FIGS. 8A and B.

The cylindrical heat pipe 40 of FIG. 7C will be understood to be essentially a flat integral base and wick (FIG. 7A) rolled into a cylinder, seamed at 41 along its length, and sealed by circular end plates, as suggested at 42. The base and wick may be as already described, using metal of sufficient ductility, such as copper. As shown, the width dimension W of the base and wick of FIG. 7A is transverse to the alignment of the grooves 16' therein. In the enlarged fragmentary detail of FIG. 7B, the groove width $w'$ is deliberately oversize, to the extent that upon rolling into cylindrical form, the grooves 16 (FIG. 7C) are of width desired for capillary action. In similar fashion, the individual openings 18' formed in the flat base and wick components (FIGS. 7A and 7B) are elliptical, being elongated in the sense of the width direction W (as shown), to enable their compression into ulitmately circular openings 18 in the inner wall of the cylindrical wick structure of FIG. 7C.

In the embodiment of FIGS. 8A and 8B, the heat pipe 45 is annular and cylindrical, having an inner wall 46 with a radially outer surface that is characterized by the described non-woven integral screen-wick formations. An outer wall 47 and end walls, as at 48, complete the sealed annular enclosure of the heat pipe 45. Construction may be as described for FIGS. 7A, B, C, except that the rolling action, from the flat of FIG. 7A, to the cylinder 46, is the inside-out of that for FIG. 7C; it will be understood that in view of the screen-wick stretch necessary to provide the cylinder 46 (as distinguished from the compression to produce cylinder 40 in FIG. 7C), the width $w''$ of grooves 16'' is less than desired at 16 in FIG. 8B, and the elongation of openings 18'' prior to rolling to cylindrical form is in the longitudinal direction, as shown in FIG. 8A, to assure circular openings 18 in the finished structure of FIG. 8B.

FIG. 9 illustrates application of the invention to a flat heat pipe 50 of rectangular planform dimensions L and W, and with an integral non-woven screen-wick base wall 51 and upper wall 52. Walls 51–52 have aligned openings (not shown) sealed by a bushing 53 which serves the dual purpose of maintaining the spaced relation of walls 51–52 and of permitting a through-passage by which the tail or stud 54 of an electronic heat source 55 (e.g., high-power semiconductor means) may be securely mounted in the E region of the heat pipe. FIG. 9 specifically shows that the capillary grooves 56-56'-56'' at progressive distances laterally of the bushing 53 may be formed to smoothly and continuously detour the bushing 53 while maintaining adequate groove spacing for efficient heat transfer to the liquid; it will be understood that the described photo-reduction, etching and plating technique lends itself particularly well to a correct and efficient lay-out of the grooves, assuring detours which are substantially centered on the axis of bushing 53, as shown, and assuring similar and registered placement of the corresponding courses of wick openings as at 57 in the plated layer 58. Side and end walls 59–60 complete the sealed structure, and a tubular or flat heat pipe (not shown) may extract heat from the C end of the device, as at 36 in FIG. 5.

A particularly advantageous feature of my new heat pipe with integral non-woven screen wick is that capillary forces are so uniformly predicatable and reliably achievable that heat-pipe action is largely independent of the local gravity vector, for an overall length dimension L hitherto unachievable, as for lenghts of 6 inches. If greater lengths ae needed, with relative independence of the gravity vector, the invention lends itself to cascaded employment of similar heat-pipe units, as illustrated in FIG. 10, wherein three like flat heat-pipe elements 61-62-63 are assembled in cascade, in a vertical orientation, to serve a heat source 64. The units 61-63 are shown equally overlapped by unit 62, and the integral base-wick wall of each unit (suggested by adjacent dashed lines 61'-62'-63') are in extensive heat-transfer contact over the regions of overlap. Thus, the E region of unit 61 boilds in response to heat input (i.e., as it extracts heat) from source 64; the E region of unit 62 boils in response to heat input (i.e., as it extracts heat) from the source represented by the C end of unit 61' and the E region of unit 63 boils in response to heat input (i.e., as it extracts heat) from the source represented by the C end of unit 62. Finally, heat from the C end of unit 63 is suitably remotely transmitted by suitable means 65.

FIGS. 11 to 14 serve to illustrate detail of a specific construction which as been found to exhibit independence from the gravity vector for a distance D of about six inches, from a boiling region 70 to a condensing region 71. The base of the elongate flat heat-transfer structure is a single piece of copper having a necked region 72 between enlarged end regions 73–74, and with a flat bottom surface (fully exposed in FIG. 11) for ease of mounting, including cascaded assembly, as where the boiling region 73 of a second such construction is mounted face-to-face with the condensation region 74 of the device of FIG. 11. As shown in FIG. 11, the housing side plates 75 of an electronic power amplifier 76 are secured at 77 to the side edges of the base end 73, and the amplifier chassis is clamped by means 78 to the heat-transfer face of region 73. A suitable power output fitting 79 is shown projecting from an end of the amplifier 76.

The base is sufficiently rectangular prismatic to permit formation of an elongate guide, such as a dovetail groove 80 in the heat-transfer face thereof; except for its extreme longitudinal ends, the elongate interior cavity in the base is deeper than groove 80, as suggested by the fragment of bottom surface 84 exposed in FIG. 14 but extending continuously throughout regions 72-73-74. The base is thus a channel wherein the dovetail formations enable accurate location and retention of an elongate insert panel 81, dovetailed to fit at 80. Panel 81 extends continuously for the full length fo all regions 72-73-74 of the base, and its underside (an end of which is exposed in FIG. 13) faces and is spaced from the channel bottom 82; the inner surface of panel 81 is characterized by the capillary-groove and apertured-covering structure (screen wick) at 83 already described, the same being suggested by the simplified showing of one end in FIG. 13. Ports are provided at each longitudinal end of the cavity space which is closed by panel 81, one such part being shown at 84 (FIG. 14) and being closed by removable threaded plug means 85.

The structure of FIGS. 11 to 14 is assembled by first completeing the panel 81, with non-woven screen-wick characterizations as already described. It is then inserted into full longitudinal accommodation in the dovetail grooves 80, thus placing the apertured-groove surface 83 in spaced relation to bottom surface 82, for the full continuous longitudinal extent of regions 73-72-74, except for closure at the extreme ends, as shown (for one end) in FIGS. 11 and 12. The thus-closed cavity is then sealed, preferably by metal-soldering for best heat condution, leaving the end ports 84 as the only means of access to the cavity, for introduction of the requisite volume of heatpump liquid (e.g., water) to be used; plug means 85 thereafter complete the sealed device, which is thus readied for described assembly to amplifier means 76 (at the boiling region 73), and to cooling means suggested by 86 (at the condensing region 74).

While the invention has been described for heat pipes wherein the evaporation and condensation regions are at spaced ends of the structure, it will be understood that this was a simplification in that one of these functions may occur at a central region, with the other function at both ends. For example, evaporation may be at region centrally located along the length direction of the grooves of the integral screen wick, while condensation regions are established at opposite longitudinal end regions.

Isothermal employments of the invention are illustrative of the functional interchange of regions, suggested in the preceding paragraph, and various specific cases are shown in FIGS. 15 to 20.

In FIG. 15, an elongate flat heat pipe 90 will be recognized for its structural resemblance to that of FIGS. 11 to 14, except that the body section 91 of the heat pipe is preferably constant throughout its length, between filler-port plugs 85'-85'' at opposite ends. The panel 81 is dovetail-fitted and sealed to body 91, in the manner described for FIGS. 11 to 14, with its integral non-woven screen-wick formations communicating with the vapor groove 82' formed in body 91 and between the port locations 85'-85''. Plural potential heat sources (e.g., electronic components) P-Q-R-S are secured to body 91 along its length; each of these sources may provide more heat than the others at a given time, and yet the nature of the heat pipe 90 is such as to be isothermal regardless of where the heat happens to originate at any given time. Thus, if device R is producing heat, to the exclusion of or in greater quantity than its adjacent devices Q or S, then R is at the evaporation region, and condensation occurs on both longitudinal sides of region R, with capillary return of condensate from regions Q and S, to region R. And if the predominant heat is at region S, then condensate return will all proceed back to S from region R.

FIG. 16 will be recognized for its similarlity to FIG. 10, purely for the purpose of demonstrating isothermal properties in an array of lapped flat heat-pipe elements 92-93-94-95-96-97-98. It matters not which end of which of these elements is locally exposed to heat. The heat exposure will immediately determine a local evaporation region. Vapor flow will proceed as possible within the sealed space over the evaporation region, and condensate return will flow back to the evaporation region; the heat-pipe element or elements in lapped adjacency to the heated element will quickly transmit heat to the next adjacent heat-pipe element, until all heat-pipe elements have achieved the same temperature. With my smooth foraminated-plate wick construction over capillary grooves, I am able to reliably get capillary flow uphill for a six-inch rise, when water is the liquid medium. Thus, by staggered adjacent overlap of the like heat-pipe elements of FIG. 16, I can obtain isothermal properties under the most adverse gravitational circumstances, as long as a sufficient number of overlapping elements is employed. In FIG. 16, the height over which isothermal properties are achievable is four times the elemental height, or 24 inches.

The arrangements of FIGS. 17 to 21 are illustrative of isothermal treatment of a curved member, such as the reflector element of a parabolic antenna. In FIGS. 17 and 18, the antenna comprises an active radiating or receiving element 100 at the focus of a parabolic metal reflector dish 101, and isothermal action is achieved over the back surface of the dish, using concentric circular arrays 102 (A, B, C, D, E) of lapped arcuate heat-pipe elements, as shown at 103-104 in FIG. 18A for the case of array 102C. The lapped elements 103–104 are frusto-conical, in belts secured to each other and to the back surface of dish 101. Wick structure 105–106 for each belt of heat-pipe elements 103–104 will be understood to be as described for panel 81 in FIGS. 11 to 14, the foraminated-plate surfaces in each case being circumferentially arcuate and frusto-conical, rather than flat, but nevertheless facing its own vapor groove or passage 105'–106'; capillary grooves and the vapor groove of each heat-pipe element thus face generally radially and axially, i.e., locally perpendicular to the foraminated-plate surface. The array of heat-pipe elements 103–104 in each of the circular arrays 102 (A, B, C, D, E) will be understood to function as indicated for FIG. 16, except that the "longitudinal" extent of isothermal action is circumferential or arcuate, rather than straight. Thus, if dish 101 is part of a satellite antenna in outer space, with heat from the sun locally applied at changing locations as the sun's aspect changes, each of the heat-pipe arrays 102 (A, B, C, D, E) will quickly render the full reflector element isothermal, so that the sun's heat will not be operative on the reflector to change antenna-pattern response properiteis through changing heat differentials.

The antenna structure of FIG. 19 similarly includes active and reflector elements 100'–101' but the isothermal action follows anguarly spaced radial courses 102' (A, B, C, D, E) along the back surface of the reflector dish 101'. If the scale of dish 101' is sufficiently small, (e.g., each radial course 102A', 102B', etc. about 6 to 8 inches long for a sea-level application), then a single length of heat pipe, suitably conformed to the local parabolic contour of dish 101', could well serve each such radial course 102A', 102B', etc. For larger scales, lapped courses of the FIG. 16 variety will be understood to serve each of the courses 102A', 102B', etc.

The arrangement of FIG. 20 will be seen to combine the radial and concentric-ring isothermal treatments of FIGS. 17 and 19 into a single structure, involving concentric arrays 107 (A, B, C, D, E) of heat-pipe elements and contoured radial arrays 108 (A, B, C, D, E) of heat-pipe elements in angularly spaced relation. And in FIG. 21, I illustrate a typical intersection of such a circular array 107B with such a radial array 108C. The local circular-arc heat-pipe element 109 of array 107B continuously traverses the intersection region, and each of two adjacent heat-pipe elements 110–110' of the radial array 108C locally abuts element 109 at the intersection region, while at the outer-belt course of array 108C, a further heat-pipe element 111 laps both elements 110–110' and the arcuate element 109 of array 107B. The result is more nearly a two-dimensional realization of two-dimensional isothermal action than for either of the forms of FIGS. 17 and 19.

FIGS. 22 and 23 illustrate single-dimensional application of the isothermal technique of the invention to elongate structures. In FIG. 22, the heat-pipe means 112 is continuously mounted to the outer cylindrical conductor 113 of a coaxial cable, shown with a center conductor 114 and a filler 115 of dielectric material. In FIG. 23, the heat-pipe means 116 is applied to one of the narrow sides of a rectangular-section wave guide. In both cases, the lapping technique of FIG. 16 will be understood to be applicable, as may be dictated by length requirements, for the region to be rendered essentially isothermal.

It will be appreciated that the illustrative 6-inch capillary use for water is related to an earth-bound gravitational environment. Thus, for outer-space use, where gravitational forces are very much reduced, capillary action is achievable for substantially greater distances, as in the order of a 6-foot rise against the most severe gravity resultant. For this reason, substantially fewer and longer sealed heat-pipe elements of the invention can be used for an outer-space environment as compared with an earth-bound employment, but the principle of operation remains the same.

What is claimed is:

1. An isothermal device comprising a sealed elongate container of substantially constant section and defining an enclosed space between end regions, the length between end regions being sufficient (a) to provide evaporation service for a localized heat source that is local to a portion only of said length and wherever located along said length and (b) to provide condensate service at at least one locale longitudinally offset from such localized heat source, an internal surface of said container having a plurality of spaced elongate grooves therein and extending continuously and without obstruction through and between said regions, said grooves being of such restricted sectional dimension as to assure capillary liquid flow therethrough for a given condensable fluid selected for use therewith, and a smooth metal plate covering and continuously and integrally united to and in heat-transfer contact with said surface on both sides of and extending over each of said grooves, said plate having a plurality of openings registering with each of said grooves for communication between said grooves and the interior of said container, said openings for each groove being of lesser sectional dimension than the plate-spanned width of the groove, and being distributed along the length of the groove, and said container including a condensable fluid medium in an amount sufficient to enter said groove when condensed to a liquid and to be transported by capillary action in said grooves from a condensing region to an evaporation region of said container, wherever the evaporation region may be instantaneously located.

2. An isothermal device comprising an elongate container of substantially constant section including a generally rectangular base, side walls, end walls and a covering wall opposed to and spaced from said base and enclosing an elongate interior space between end regions, the length between end regions being sufficient (a) to provide evaporation service for a localized heat source that is local to a portion only of said length and wherever located along said length and (b) to provide condensate service at at least one locale longitudinally offset from such localized heat source, the internal surface of said base containing a plurality of spaced longitudinal grooves therein and having an integral metallic plating smoothly covering and electrolytically continuously bonded to said surface and extending over said grooves, said grooves being of such restricted sectional dimension as to assure capillary liquid flow therethrough for a given condensable fluid selected for use therewith, said plating containing a plurality of openings for communication between each of said grooves and the interior space, said openings for each groove being of lesser sectional dimension than the plate-spanned width of the groove and being distributed along the length of the groove, and said interior space containing a condensable fluid medium in an amount sufficient to enter said grooves when condensed to a liquid and to be transported by capillary action in said grooves from a condensing region to an evaporation region of said container.

3. An isothermal device according to claim 2, wherein said container is one of a plurality of like containers, said containers being in longitudinally lapped adjacency with a flat surface of one container longitudinally overlapping substantially equal parts of corresponding surfaces of two furthr containers.

4. An isothermal device according to claim 3, in which said further containers are in end-to-end adjacency.

5. An isothermal device, comprising an elongate metal body of substantially constant section and having opposed sides, said body having an elongate groove of substantially constant section open to one of said sides, and a separate elongate metal closure panel having sealed engagement to the opposed walls of the groove, the inner surface of said panel facing and being spaced from the groove bottom, and the longitudinal ends of said engaged panel and body being sealed to close the longitudinal ends of the groove, the inner surface of said panel having longitudinal screen-wick formations, and said body having a closable port for admission of condensable liquid; said panel being of substantially constant section and having a body with plural elongate capillary grooves in the inner surface thereof, and said screen-wick formations comprising a single thin foraminate plate integrally united to the grooved inner surface and smoothly and uniformly bridging the grooves.

6. The device of claim 5, in which the elongation of said body is curved along a generally arcuate course, said opposed sides being radially spaced.

7. The device of claim 5, in which the elongation of said body is curved along a generally arcuate course, said opposed sides being axially spaced.

8. The device of claim 5, in which the elongation of said body extends circumferentially about a central axis, said opposed sides being radially spaced.

9. The device of claim 5, in which the elongation of said body extends circumferentially about a central axis, said opposed sides being axially spaced.

10. An antenna-element reflector construction, comprising a metal plate of desired radiation-reflecting contour on a front surface thereof, and an isothermal device according to claim 5, wherein the metal body of the isothermal device is secured to and extends on a course along a back-surface region of said plate, with the course of the body groove locally conformed to the secure course of said device to said plate.

11. An antenna-element construction according to claim 10, in which the reflecting contour is parabolic, and in which said secured course is generally along the arc of a circle in said contour and about the axis of the parabolic contour.

12. An antenna-element construction according to claim 10, in which the reflecting contour is parabolic, and in which said secured course is generally radial in said contour and with respect to the axis of the parabolic contour.

13. An antenna-element construction according to claim 10, in which said isothermal device is one of a plurality on different secured courses along said contour.

14. An antenna-element construction according to claim 13, in which the secured courses of different isothermal devices intersect, for effective two-dimensional isothermal treatment of said surface.

* * * * *